US006966504B2

(12) United States Patent
Stier et al.

(10) Patent No.: US 6,966,504 B2
(45) Date of Patent: Nov. 22, 2005

(54) FUEL INJECTOR

(75) Inventors: Hubert Stier, Asperg (DE); Norbert Keim, Loechgau (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/169,858

(22) PCT Filed: Nov. 9, 2001

(86) PCT No.: PCT/DE01/04188

§ 371 (c)(1),
(2), (4) Date: Feb. 20, 2003

(87) PCT Pub. No.: WO02/38946

PCT Pub. Date: May 16, 2002

(65) Prior Publication Data

US 2004/0055566 A1 Mar. 25, 2004

(30) Foreign Application Priority Data

Nov. 9, 2000 (DE) ..... 100 55 513

(51) Int. Cl.[7] ..... F02M 61/00

(52) U.S. Cl. ..... 239/533.12; 239/533.2; 239/533.3; 239/585.1; 239/585.2; 239/585.3; 239/585.4; 239/585.5

(58) Field of Search ..... 239/533.2, 533.3, 239/533.12, 585.1, 585.2, 585.3, 585.4, 585.5

(56) References Cited

U.S. PATENT DOCUMENTS

| | | | | |
|---|---|---|---|---|
| 4,771,984 A | * | 9/1988 | Szablewski et al. | 239/585.4 |
| 4,971,254 A | | 11/1990 | Daly et al. | |
| 5,058,549 A | | 10/1991 | Hashimoto et al. | |
| 5,108,037 A | * | 4/1992 | Okamoto et al. | 239/533.12 |
| 5,190,221 A | * | 3/1993 | Reiter | 239/585.1 |
| 5,746,376 A | | 5/1998 | Romann et al. | |
| 6,095,113 A | * | 8/2000 | Nogi et al. | 239/533.12 |
| 6,145,761 A | * | 11/2000 | Muller et al. | 239/533.12 |
| 6,173,914 B1 | | 1/2001 | Hopf et al. | |
| 6,296,199 B1 | * | 10/2001 | Noller et al. | 239/533.12 |
| 6,367,720 B1 | * | 4/2002 | Okamoto et al. | 239/585.1 |
| 6,405,945 B1 | * | 6/2002 | Dobrin | 239/533.12 |
| 2001/0027772 A1 | * | 10/2001 | Okamoto et al. | 123/305 |

FOREIGN PATENT DOCUMENTS

| | | | |
|---|---|---|---|
| DE | 16 01 988 | 12/1971 | |
| DE | 39 43 005 | 7/1990 | |
| DE | 39 40 585 | 6/1991 | |
| DE | 40 39 520 | 7/1991 | |
| DE | 44 45 358 | 6/1996 | |
| DE | 197 26 991 | 1/1999 | |
| DE | 199 07 859 | 3/2000 | |
| WO | WO91/09222 | 6/1991 | |
| WO | WO 9109222 A1 * | 6/1991 | F02M/51/06 |
| WO | WO 99 00201 | 1/1999 | |
| WO | WO 00 12891 | 3/2000 | |

* cited by examiner

*Primary Examiner*—David A. Scherbel
*Assistant Examiner*—James S. Hogan
(74) *Attorney, Agent, or Firm*—Kenyon & Kenyon

(57) ABSTRACT

A fuel injector, in particular for the direct injection of fuel into a combustion chamber of an internal combustion engine, includes a valve needle that has at its injector end a valve-closure member that works together with a valve-seat surface formed on a valve-seat member, to form a sealing seat. The fuel injector also includes at least one swirl duct; a swirl chamber formed on the valve-seat member, and a plurality of injection openings that open out from the swirl chamber, through which the fuel, provided with a swirl, is simultaneously injected. The at least one swirl duct is formed in the valve-seat member or in a swirl disk adjacent to the valve-seat member.

13 Claims, 3 Drawing Sheets

FUEL INJECTOR

FIELD OF THE INVENTION

The present invention relates to a fuel injector.

BACKGROUND INFORMATION

U.S. Pat. No. 5,058,549 describes a fuel injector that has a device for producing swirl, as well as main injection opening having a large diameter and a secondary injection opening having a smaller diameter. The inclination of the injection openings in relation to a longitudinal axis of the fuel injector differs, so that the fuel is injected through the secondary injection opening with a high degree of swirl and a large penetration length, and is injected through the main injection opening with a low degree of swirl and with a large opening angle.

One disadvantage of the fuel injector described in U.S. Pat. No. 5,058,549 may be, in particular, the high manufacturing expense both of the valve-closure member and/or of the valve needle, which must be provided with swirl grooves, and also of the valve-seat member, in which the injection openings are formed. In particular, the differing inclination of the injection openings and the high demands on the precision of the diameter of the injection openings require an expensive manufacturing process.

In addition, German Patent No. 1 601 988 describes a fuel injector having a valve needle whose shaft is guided in the bored opening of a valve guide part. When fuel under pressure is supplied, the fuel injector opens in the direction of flow of the fuel via radial cross-bores that are situated in the guide part and that run into the guide bore, and places the fuel into rotation using grooves. In addition, the fuel injector has at least two injection openings at the flow-off side of the valve needle.

One disadvantage of the fuel injector described in German Patent No. 1 601 988, in particular, the disturbance of the swirl of the fuel due to the outwardly directed opening motion, caused especially by the large dead volume of a swirl chamber formed between the valve-closure member and the injection openings. The swirl flow can no longer be kept homogenous, and when the fuel injector is opened the cross-section of the grooves increases so strongly that the swirl flow ceases.

SUMMARY

An example embodiment of the fuel injector according to the present invention may have the advantage that advantageous features of a multi-hole fuel injector are combined with those of a fuel injector having swirl preparation, with extensive use of standard components. This may be achieved in that a swirl device, for example a conventional swirl disk, is situated at the inflow side of a swirl chamber and communicates a swirl to the fuel, so that a homogenous swirl flow is formed in the swirl chamber. Due to the homogenous swirl flow, the fuel can be injected simultaneously through a plurality of injection openings that are for example formed in a valve-seat member known from multi-hole nozzle technology.

The formation of swirl ducts in a guide extension of the valve-closure member may be advantageous because in addition to the swirl-producing disposition of the inflow opening, an offset-free guiding of the valve-closure member is also possible.

The swirl flow in the swirl chamber can be adjusted as required through a tangential component relative to a longitudinal axis of the fuel injector.

In particular, the embodiment of the swirl device as a swirl disk may be advantageous because this can be easily manufactured and easily installed.

In addition, it is advantageous that arbitrary dispositions of injection openings can be realized according to the demands made on the shape of the mixture cloud.

BRIEF DESCRIPTION OF THE DRAWINGS

Exemplary embodiments of the present invention are shown in simplified form in the drawing, and are explained in more detail in the subsequent specification.

DETAILED DESCRIPTION

Figure 1A:
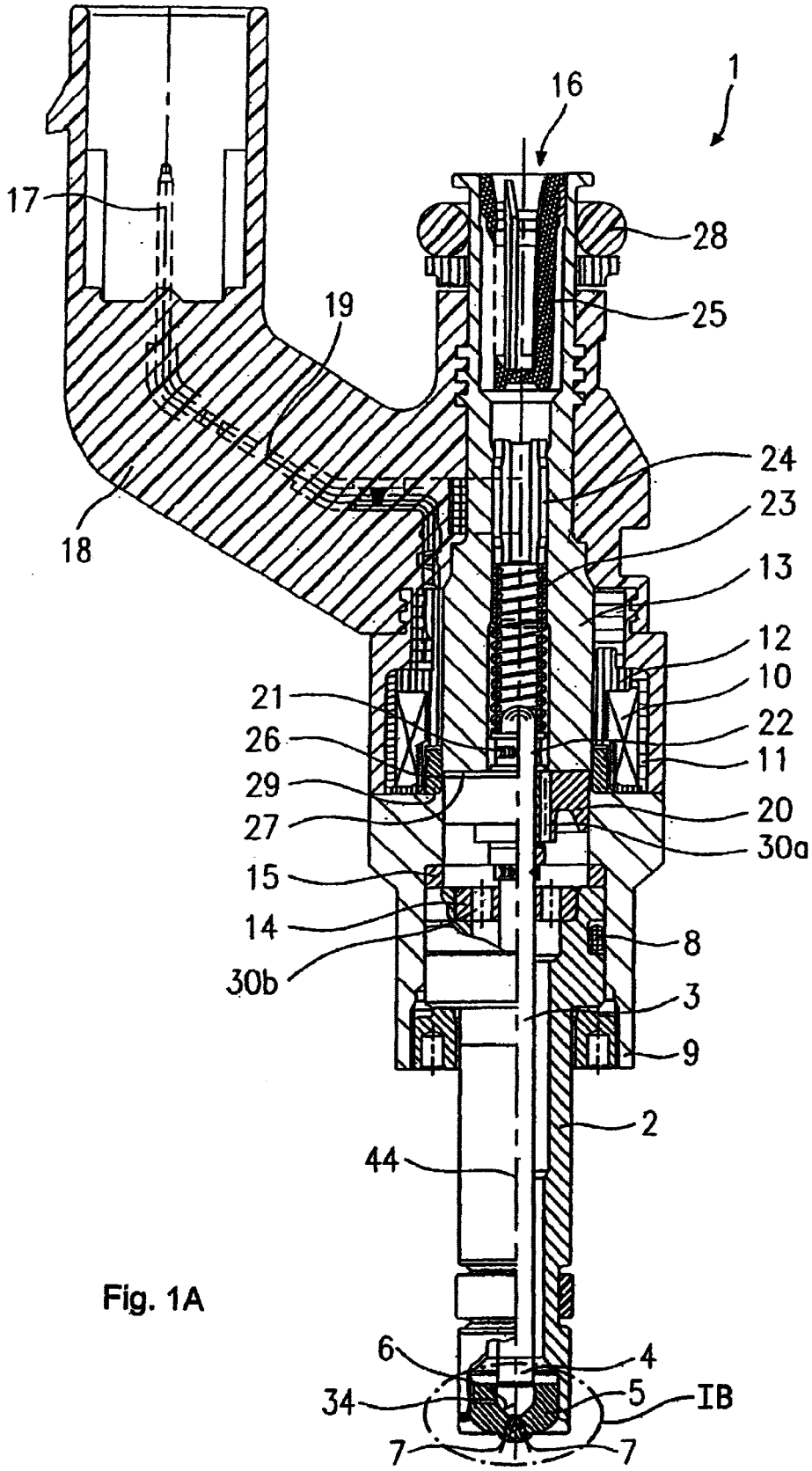
FIG. 1A shows a schematic section through a first exemplary embodiment of a fuel injector according to the present invention.

In accordance with a first exemplary embodiment of the present invention, shown in FIG. 1A, a fuel injector 1 is provided in the form of a fuel injector 1 for fuel injection systems of mixture-compressing, spark-ignited internal combustion engines. Fuel injector 1 is in particular suitable for the direct injection of fuel into a combustion chamber (not shown) of an internal combustion engine.

Fuel injector 1 is made up of a nozzle element 2 in which a valve needle 3 is situated. Valve needle 3 is effectively connected with a valve-closure member 4 that works together with a valve-seat surface 6, situated on a valve-seat member 5, to form a sealing seat. The exemplary embodiment of fuel injector 1 is an inwardly opening fuel injector 1 having a plurality of injection openings 7. Nozzle element 2 is sealed by a seal 8 against outer pole 9 of a magnet coil 10. Magnet coil 10 is encapsulated in a coil housing 11 and is wound on a coil bearer 12 that is adjacent to an inner pole 13 of magnet coil 10. Inner pole 13 and outer pole 9 are separated from one another by a gap 26, and are supported on a connecting component 29. Magnet coil 10 is excited, via a line 19, by an electrical current that can be supplied via an electrical plug contact 17. Plug contact 17 is surrounded by a plastic sheath 18 that can be sprayed onto inner pole 13.

Valve needle 3 is guided in a valve needle guide 14 constructed in the form of a disk. An adjustment disk 15 paired therewith is used for the stroke adjustment. An armature 20 is located on the other side of adjustment disk 15. This armature is connected non-positively, via a first flange 21, with valve needle 3, which is connected with first flange 21 by a welded seam 22. A reset spring 23 is supported on first flange 21, said spring being brought to pre-tension through a sleeve 24 in the present construction of fuel injector 1.

A second flange 31, connected with valve needle 3 via a welded seam 33, acts as a lower armature stop. An elastic intermediate ring 32, which lies on second flange 31, may prevent bouncing during the closing of fuel injector 1.

In valve needle guide 14 and in armature 20 there run fuel ducts 30*a* and 30*b* that conduct the fuel—supplied via a central fuel supply line 16 and filtered by a filter element 25—to injection openings 7. In valve-seat member 5, inflow openings 34 are provided both for fuel conduction and for swirl preparation. Fuel injector 1 is sealed against a fuel supply line (not shown in more detail) by a seal 28.

In the idle state of fuel injector 1, armature 20 is loaded by reset spring 23 against its stroke direction in such a way that valve-closure member 4 is held in the sealing position on valve-seat surface 6. When magnet coil 10 is excited, this coil builds up a magnetic field that moves armature 20 against the spring force of reset spring 23 in the stroke direction, the stroke being predetermined by a working gap 27 located, in the idle position, between inner pole 12 and armature 20. Armature 20 also carries flange 21, which is welded to valve needle 3, along in the stroke direction. Valve-closure member 4, which is effectively connected with valve needle 3, lifts off of valve-seat surface 6, and the fuel, supplied to injection openings 7 via fuel ducts 30*a* and 30*b* and via inflow openings 34 in valve-seat member 5, is injected.

Figure 1B:
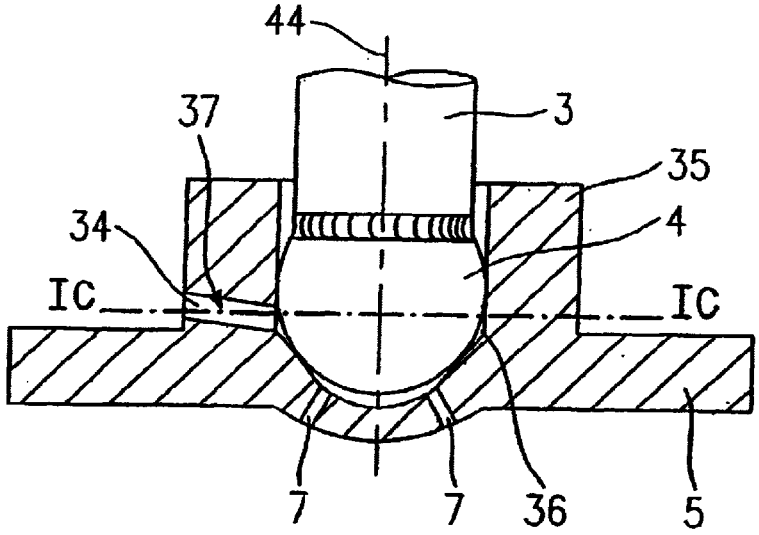
FIG. 1B shows a schematic partial section through the first exemplary embodiment, shown in FIG. 1, of a fuel injector according to the present invention, in region IB of FIG. 1A.
Figure 1C:
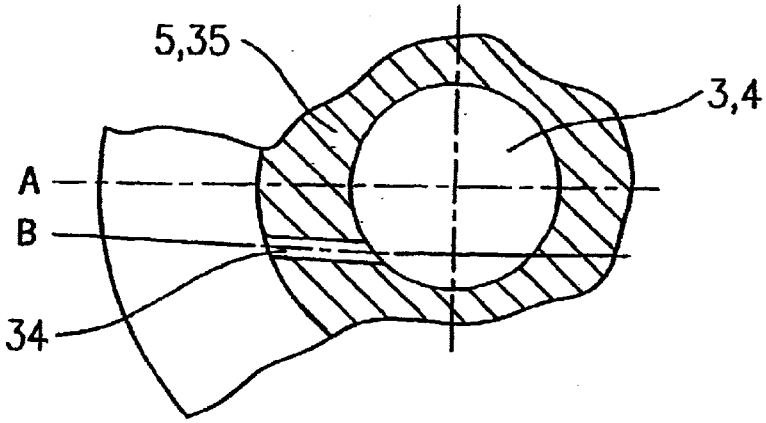
FIG. 1C shows a schematic section along the line designated IC—IC in FIG. 1B.

Via an eccentric disposition, described in more detail in FIGS. 1B and 1C, of inflow openings 34 in valve-seat member 5, the first exemplary embodiment of a fuel injector 1 according to the present invention combine the advantages of swirl-preparing measures with the advantages of fuel injectors 1 having a plurality of injection openings 7.

If the coil current is switched off, after sufficient decomposition of the magnetic field armature 20 falls away from inner pole 13 due to the force of reset spring 23, thus moving flange 21, which is effectively connected with valve needle 3, against the stroke direction. In this way, valve needle 3 is moved in the same direction, so that valve-closure member 4 is placed on valve-seat surface 6 and fuel injector 1 is closed.

FIG. 1B shows, in an excerpted, schematized sectional representation, the injector end of fuel injector 1 according to the present invention shown in FIG. 1A. The segment shown in FIG. 1B is designated IB in FIG. 1A. Corresponding components have been provided with corresponding reference members.

The injector end, shown in FIG. 1B, of fuel injector 1 according to the present invention from FIG. 1A includes a valve-seat member 5 that has at least one inflow opening 34, which acts as a swirl duct 37 and is formed in a hollow cylindrical guide extension 35 that is either formed in one piece with valve-seat member 5 or is connected with valve-seat member 5 via welding, soldering, or a similar method. Valve needle 3, with valve-closure member 4 formed thereon, is guided through guide extension 35 in order to avoid mismatches, so as to ensure error-free operation of fuel injector 1.

In this embodiment, at least two injection openings 7 are formed in valve-seat member 5. The two injection openings 7 shown in FIG. 1B can for example be part of an annular system of injection openings 7 made up of one or more preferably concentric rings.

Between valve-seat member 5 and valve-closure member 4, a swirl chamber 36 is formed that preferably has the shape of a cylindrical shell, whose volume is preferably dimensioned such that the dead volume is minimal, and such that a circumferentially directed swirl flow can form when fuel flows into swirl chamber 36.

FIG. 1C shows, in an excerpted, schematic, sectional representation, a section through the exemplary embodiment shown in FIG. 1B of fuel injector 1 according to the present invention, along the line IC—IC.

In order to clarify the swirl-producing disposition of inflow opening 34, acting as swirl duct 37, two lines A and B are introduced that represent the eccentricity of inflow opening 34. Through a tangential component of inflow opening 34 relative to a longitudinal axis 44 of fuel injector 1, fuel does not enter in directly radial fashion into swirl chamber 36, formed between valve-seat member 5 and valve-closure member 4, so that a swirl flow oriented in the circumferential direction can form. The swirl flow transports the fuel uniformly to all injection openings 7, so that a homogenous and symmetrical fuel cloud can be produced.

For reasons of clarity, in FIG. 1C only one inflow opening 34 is shown. However, for reasons of symmetry at least two, or more advantageously four or more, inflow openings 34 may be present, in order on the one hand to ensure symmetry of the forces acting due to the flowing fuel, and on the other hand in order to adapt the injected fuel cloud as well as possible to the stoichiometric requirements.

Figure 2:
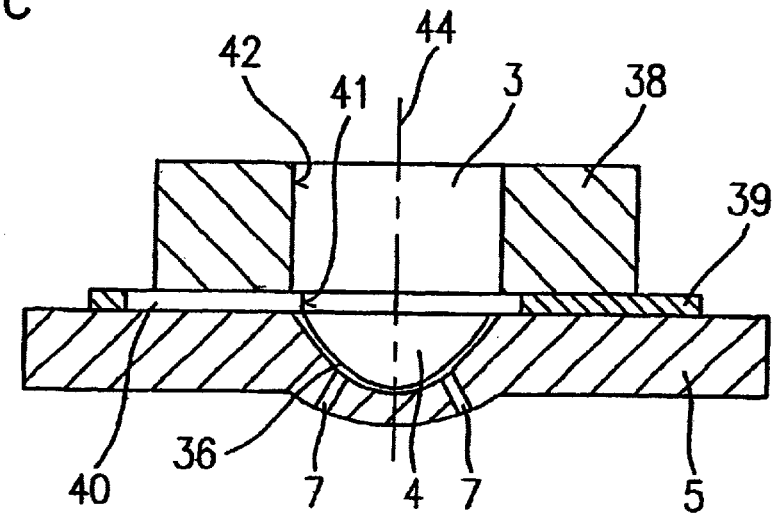
FIG. 2 shows a schematic partial section through a second exemplary embodiment of a fuel injector according to the present invention, in the same region as in FIG. 1B.

In FIG. 2, a second exemplary embodiment of a fuel injector 1 constructed according to the present invention is shown, in the same region as in FIG. 1B.

In contrast to the previous exemplary embodiment, in the second exemplary embodiment the part of fuel injector 1 at the flow-off side is made up of three components that are manufactured separately and then assembled. At the inflow side of valve-seat member 5, a swirl disk 39 is situated that has at least one, and advantageously more than two, swirl ducts 40. In the present exemplary embodiment, the displacement-free guiding of valve needle 3, or of valve-closure member 4, is ensured by a guide element 38. Guide element 38 and swirl disk 39 here each have an opening 41, 42, through which valve needle 3 extends. Guide element 38 and swirl disk 39 can for example be connected with one another, and with valve-seat member 5, by soldering, welding, gluing, or other connective methods.

A swirl chamber 36 is in turn formed between valve-closure member 4 and valve-seat member 5, and homogenizes the swirl flow caused by the fuel flowing through swirl disk 39 in swirl chamber 36.

Figure 3A:
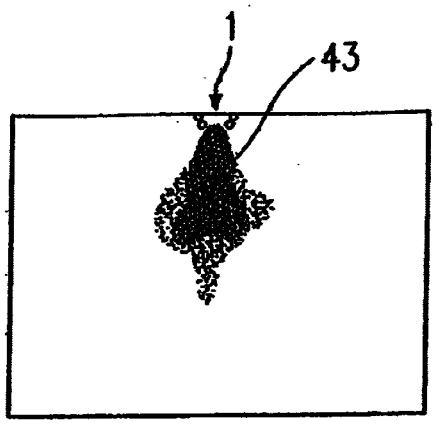
FIGS. 3A–C show spray patterns of a conventional fuel injector having swirl preparation, as well as of a fuel injector with multi-hole nozzle with and without swirl
Figure 3B:
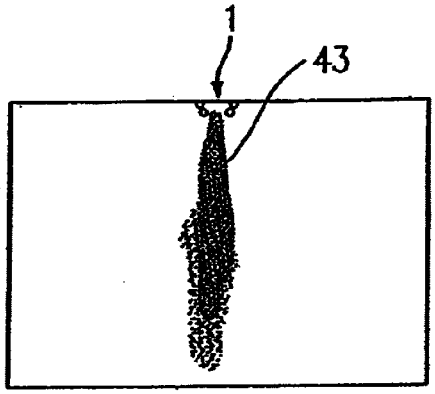
Figure 3C:
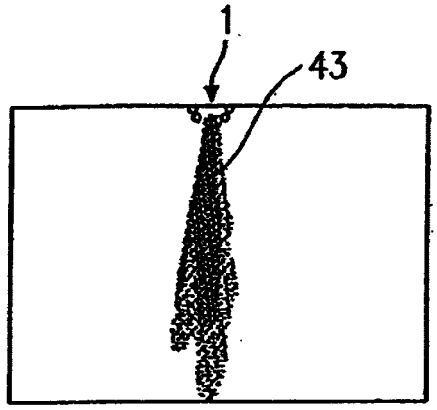
Figure 4:
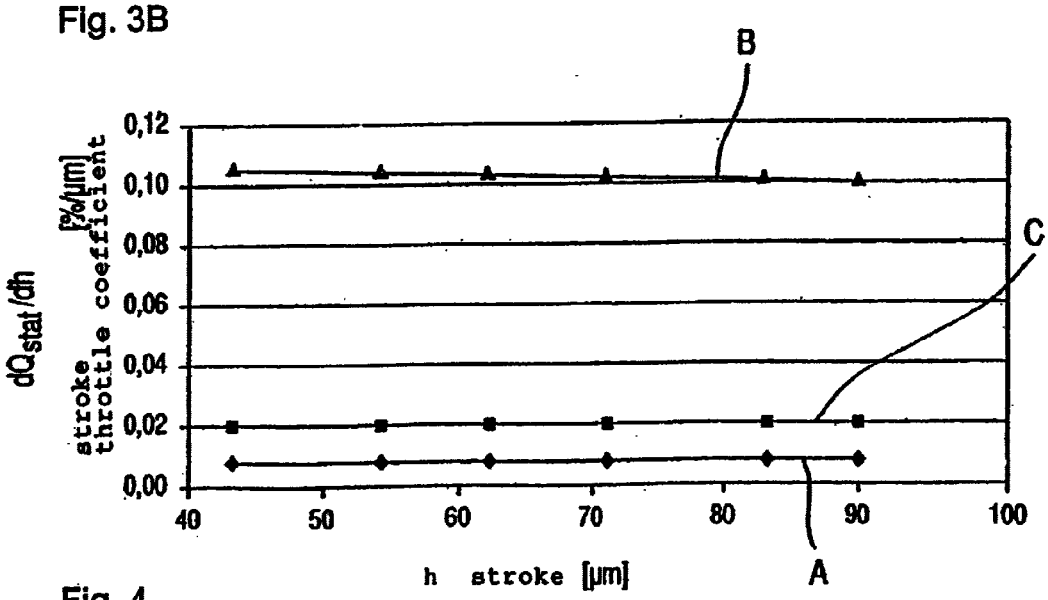
FIG. 4 shows a diagram of the static flow dependent on the stroke of the valve needle for the spray patterns, shown in FIGS. 3A–3C, of fuel injectors.

FIGS. 3A to 3C show schematic spray patterns of various fuel injectors 1 with and without swirl preparation, and having one or more injection openings 7. FIG. 4 is to be regarded in connection with FIGS. 3A to 3C; FIG. 4 shows the stroke throttle coefficients of the differently constructed fuel injectors 1 dependent on the stroke of the valve needle. The stroke throttle coefficient $dQ_{stat}/dh$ describes the change of the static flow $Q_{stat}$ with the stroke h of valve needle 3.

FIG. 3A shows the spray pattern of a fuel injector 1 having conventional swirl preparation, for example having a swirl disk 39, and having only one injection opening 7. The swirl preparation produces a relatively homogenous mixture cloud 43, which, however, conditioned by the shape of injection opening 7, opens relatively widely, and thus does not achieve a deep penetration of the combustion chamber. Modifications in the shape of injection opening 7 are not satisfactory in the production of mixture cloud 43, because of noticeable disturbances due to throttle effects and turbulence; for this reason, the penetration of the combustion chamber is limited by an injection opening 7 that cannot be further miniaturized.

However, an advantage of the conventional swirl preparation in conjunction with the pressure of only one injection opening 7 is the good behavior of the system with respect to stroke throttle effects. The change of the static flow of fuel through fuel injector 1 with the stroke of valve needle 3 is very low, so that the scatter of the static flow likewise remains low.

Curve A in FIG. 4, associated with FIG. 3A, is identified by lozenges. For fuel injector 1, equipped with conventional swirl preparation and only one injection opening 7, the stroke throttle coefficient is constant over the stroke of valve needle 3 at approximately 0.01%/μm. That is, the static flow of fuel through fuel injector 1 depends only very weakly on changes in the stroke.

In comparison, FIG. 3B shows the spray pattern of a fuel injector 1 without swirl preparation, but which is however provided with a plurality of injection openings 7 according to known multi-hole designs.

Here, the penetration of the combustion chamber is significantly greater, and mixture cloud 43 penetrates almost three times as far into the combustion chamber as does mixture cloud 43 shown in FIG. 3A. The reason for this is, in particular, the large number of very small injection openings 7, which prevent throttle effects and produce sharp injection jets that superpose to form a stoichiometric mixture cloud 43.

A disadvantage of multi-hole fuel injectors 1 without swirl preparation is, in particular, the strong dependence of the static fuel flow on the stroke of valve needle 3. Due to this, the static flow scatters so strongly that the required small injected fuel quantities often cannot be maintained, resulting in malfunctions of the internal combustion engine such as incomplete combustion of the injected fuel, as well as afterburning reactions and knock.

FIG. 4, curve B, associated with FIG. 3B, is identified with triangles. For a fuel injector 1 equipped with a plurality of injection openings 7, according to conventional multi-hole designs, the stroke throttle coefficient is approximately 0.1%/μm, which is approximately 10 times the value of fuel injector 1 with swirl preparation shown in FIG. 3A. The static flow of fuel through fuel injector 1 depends strongly on the stroke of valve needle 3, which can result in a high degree of scatter in the injected fuel quantities.

In FIG. 3C, the spray pattern of a fuel injector 1 constructed according to the present invention, having swirl preparation as well as a plurality of injection openings 7, is shown.

In comparison to FIG. 3B, the spray pattern of fuel injector 1 according to the present invention has only insignificant differences; that is, the depth of penetration of mixture cloud 43 in the combustion chamber continues to achieve satisfactory values, while the tolerance of the flow of fuel in relation to changes in stroke approximates the value for fuel injector 1 having swirl preparation shown in FIG. 3A.

Curve C in FIG. 4 corresponds to the spray distribution shown in FIG. 3C. The stroke throttle coefficient, identified in FIG. 4 with squares, of fuel injector 1 according to the present invention still achieves a value of approximately 0.02%/μm, which is only insignificantly greater than the value of fuel injector 1 having swirl preparation, shown in FIG. 3A.

Fuel injector 1 constructed according to the present invention thus has a high depth of penetration of mixture cloud 43 in the combustion chamber, as well as only a small dependence of the static flow on the stroke of valve needle 3, and correspondingly has only a slight scatter of the static flow.

The present invention is not limited to the exemplary embodiments shown, and can for example also be applied to fuel injectors 1 having other dispositions of swirl-preparing devices, having more or fewer inflow openings 34, or having swirl disks having more or fewer swirl ducts 40, as well as for arbitrary constructive forms of fuel injectors 1.

What is claimed is:

1. A fuel injector, comprising:

a valve needle having an injector end;

a valve-seat member having a valve-seat surface;

a valve-closure member at the injector end of the valve needle, the valve-closure member interacting with the valve-seat surface to form a sealing seat;

at least one inflow opening arranged as a swirl duct formed in one of: i) the valve-seat member, and ii) in a swirl disk adjacent to the valve-seat member, the at least one inflow opening disposed eccentrically in one of: i) the valve seat member and ii) the swirl disk to provide a tangential component of the inflow opening relative to a longitudinal axis of the fuel injector;

a swirl chamber formed on the valve-seat member; and a plurality of injection openings provided in the valve-seat member and opening out from the swirl chamber to form and angle between longitudinal axes of the injector openings with respect to the longitudinal axis of the fuel injector, and through which fuel provided with an angular momentum is simultaneously injected.

2. The fuel injector as recited in claim 1, wherein the fuel injector is configured to directly inject fuel into a combustion chamber of an internal combustion engine.

3. The fuel injector as recited in claim 1, wherein the swirl duct is situated at an inflow side of the sealing seat.

4. The fuel injector as recited in claim 1, wherein the valve-seat member includes a guide extension, the swirl duct formed by inflow openings that are formed in the guide extension.

5. The fuel injector as recited in claim 4, wherein the guide extension is one of: i) formed in one piece with the valve-seat member, and ii) welded, soldered, or cemented to the valve-seat member.

6. The fuel injector as recited in claim 4, wherein the inflow openings have a tangential component in relation to the longitudinal axis of the fuel injector.

7. The fuel injector as recited in claim 1, wherein the fuel injector includes the swirl disk, the swirl disk being situated between a guide element and the valve-seat member.

8. The fuel injector as recited in claim 7, wherein at least one of the valve needle and the valve-closure member penetrates the guide element and the swirl disk through openings.

9. The fuel injector according to claim 1, wherein the injection openings are part of an annular system of injection openings made up of at least one concentric ring.

10. The fuel injector according to claim 1, wherein the at least one swirl duct is angled toward the plurality of injection openings.

11. The fuel injector as recited in claim 9, wherein the guide extension is one of: i) formed in one piece with the valve-seat member, and ii) welded, soldered, or cemented to the valve-seat member.

12. The fuel injector as recited to claim 10, wherein the guide extension is one of:

i) formed in one piece with the valve-seat member, and ii) welded, soldered, or cemented to the valve-seat member.

13. The fuel injector as recited in claim 10, wherein the fuel injector includes the swirl disk, the swirl disk being situated between a guide element and the valve-seat member.

* * * * *

UNITED STATES PATENT AND TRADEMARK OFFICE

CERTIFICATE OF CORRECTION

PATENT NO. : 6,966,504 B2
DATED : November 22, 2005
INVENTOR(S) : Hubert Stier et al.

It is certified that error appears in the above-identified patent and that said Letters Patent is hereby corrected as shown below:

Column 1,
Line 9, change “as well as main injection” to -- as well as a main injection --.

Column 6,
Line 22, change “form and angle” to -- form an angle --.

Signed and Sealed this

Seventh Day of March, 2006

JON W. DUDAS
*Director of the United States Patent and Trademark Office*